United States Patent [19]

Derail

[11] 3,964,247

[45] June 22, 1976

[54] FALSE TWIST SPINDLE

[75] Inventor: Yves Derail, Ambierle, France

[73] Assignee: Chavanoz S.A., Chavanoz, France

[22] Filed: Oct. 10, 1974

[21] Appl. No.: 513,625

[30] Foreign Application Priority Data

Oct. 25, 1973 France ..... 73.38408

[52] U.S. Cl. ..... 57/77.45; 57/1 R; 181/33 K

[51] Int. Cl.[2] ..... D02G 1/06

[58] Field of Search ..... 57/77.3, 77.45, 1 R, 57/112; 181/33 K

[56] References Cited

UNITED STATES PATENTS

| | | | |
|---|---|---|---|
| 3,304,706 | 2/1967 | Mattingly | 57/77.45 |
| 3,393,765 | 7/1968 | Vitrinsky et al. | 57/1 R X |
| 3,604,191 | 9/1971 | Joeggli | 57/1 R |
| 3,713,509 | 1/1973 | Carroll | 57/1 R X |
| 3,782,087 | 1/1974 | Franzen et al. | 57/1 R |

*Primary Examiner*—Donald O. Woodiel
*Assistant Examiner*—Charles Gorenstein
*Attorney, Agent, or Firm*—H. William Petry; Luke J. Wilburn, Jr.

[57] ABSTRACT

The invention relates to an improved false twist spindle having means for attenuating noises which are emitted during operation. The spindle according to the invention contains sound-reducing means which allow free access to the various components of the spindle, which means are formed by an enveloping insulating plate which partly surrounds the spindle assembly, and an insulating ring or cylinder surrounding the twist tube in its part equipped with the twist locking means.

The invention applies primarily to high-speed false twist spindles in which the twist is imparted by means of a twist tube equipped with twist locking means.

4 Claims, 4 Drawing Figures

FALSE TWIST SPINDLE

The present invention is directed to an improvement in machines designed to texturize textile threads by false twist process, and, more particularly, to an improved false twist spindle in which the false twist is imparted to the thread by means of a tubular twist tube having a skewered pin equipped with means for locking the twist.

In this type of spindle, the most widespread in the false twist texturing field, the false twist tube is driven in fast rotation by a suitable drive means. In recent years, improvements made in false twist spindles have dealt primarily with increased speed of rotation of the twist tubes, which at present revolve at more than 600,000 rpm.

In order to reach these speeds, spindles were developed, in which the tube or spindlette is drawn magnetically against the driving means, which means are constituted either by two rollers with parallel faces holding the tube by their cooperation (commonly designated as "two-roller spindles"), or by a single roller with faces, these spindles being commonly designated as "single-roller spindles," tube being drawn directly against the faces, and being centered axially by a magnetic flux acting on its ends.

But this increase in the speed of rotation of the false-twist spindles poses a serious problem of noise. As a matter of act, for the speeds commonly reached today, there is a constantly rising emission of sound, the level of which emission reaches and very often exceeds the threshold allowed by law in industrialized countries. It has been ascertained that the total sonic intensity at 600,000 rpm is on the order of 100 decibels in normal operation. In certain cases the sonic emissions have been reduced by surrounding the roller or rollers with a shielding. But this does not give complete satisfaction because on the one hand the sonic emissions are still very high, and on the other hand, above all, access to the drive roller or rollers is made very difficult if not impossible. There has now been found, and this is the object of the present invention, a simple and effective device which makes it possible to substantially diminish the sonic emissions of a false-twist texturing spindle revolving at very high speed, while allowing free access to the driving rollers and the twist tube.

In the remainder of the description, the invention will be described as applied more particularly to spindles in which the twist tube is applied magnetically against drive means formed of two rollers with parallel faces, said spindles will be designated by the expression "two-roller."

According to the invention, sonic emissions from the spindle are diminished by the adding of sound insulation elements formed on the one hand by an insulating jacket partly surrounding the spindle assembly, and on the other hand, by an insulating ring surrounding the twist tube in its part equipped with the twist locking member, the said ring being concentric to the twist tube and spaced from the latter.

In a preferred method of embodiment, the insulating jacket appears in the form of a semi-cylindrical screen, open at both ends, fixed to the frame supporting the spindle, and positioned at the front of the latter; the insulating ring is cylindrical in shape and is attached to the frame. Preferably, the length of this ring is greater than the length of the part of the twist tube bearing the twist locking elements. Optionally, the cylindrical insulating jacket can be held in place by being gripped between the arms of a U-shaped support attached to the frame at its rear part, which permits the removability of the ring.

Finally, according to the invention, the insulating elements are advantageously made of a material with a non-magnetic base, such as analuminum, and are optionally covered, on their face turned toward the spindle, with a soft lining which can absorb noises, e.g., plastic material, polyurethane, cellular rubber, etc.

The advantages and the application of the invention will be better understood by reference to the following example given by way of indication, with the understanding that the invention extends to any variant in the same spirit.

This example is illustrated by the accompanying drawings, in which

As previously mentioned, a false-twist spindle contains, essentially, a twist tube and means for driving the twist tube in rotation.

Figure 1:
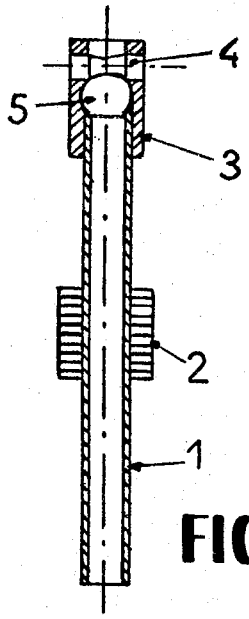
FIG. 1 shows in schematic longitudinal section, a classic falst-twist tube.

As shown in FIG. 1, the twist tube comprises a metal tube 1, on which are mounted, in the middle part, a body 2 of stacked laminated sheets of metal, designed for magnetic retention, and at one end a bored head 3 in which there is fixed, transversely to the bore of the tube, a twist locking bar or pin 4 of hard ceramic, below which a cylindrical hole 5 passes through head 3 from side to side. This hole is used for the passage of the thread in the twist tube for threading it about the bar. The twist tube head, instead of having a cylindrical hole, may optionally be slotted at the top, the bar likewise being placed transversely with respect to this slot.

Figure 2:
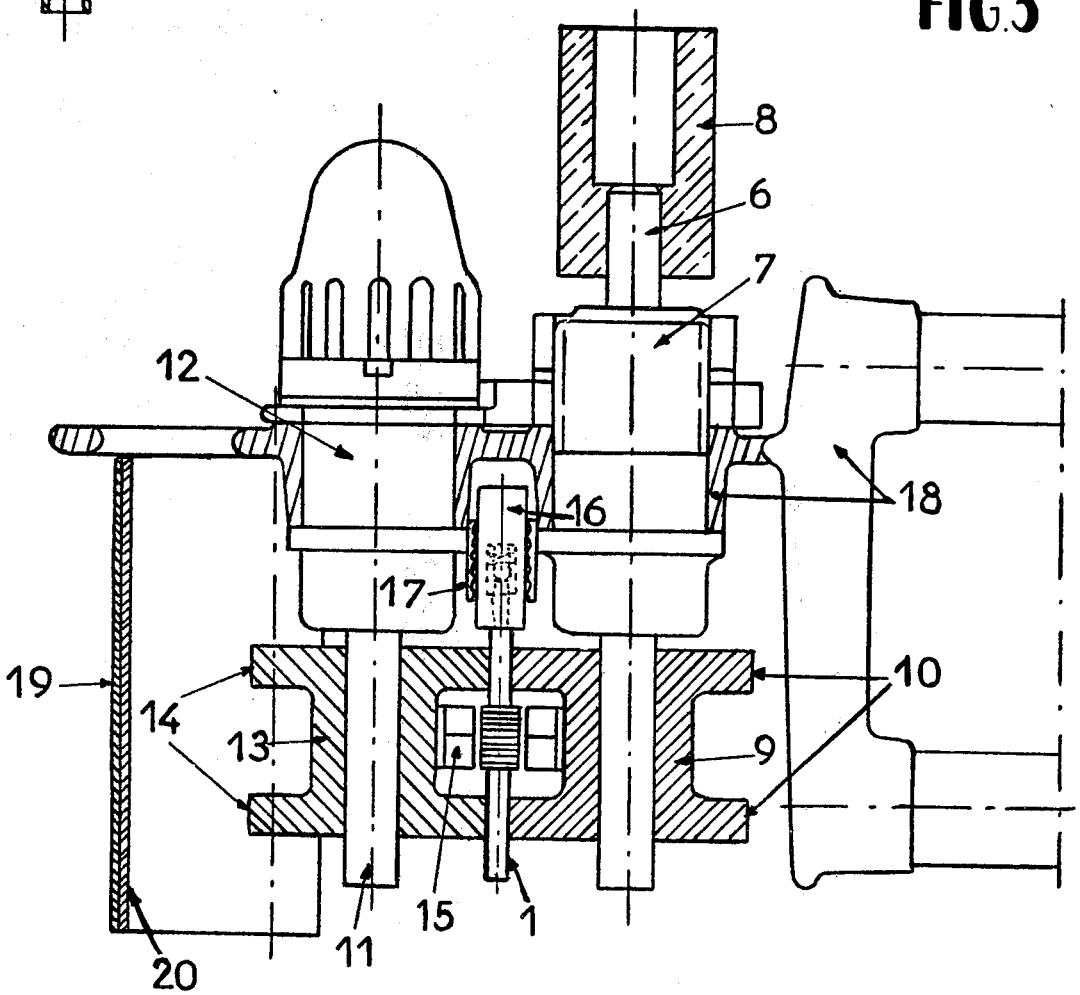
FIG. 2 shows a side elevation view of a two-roller false-twist spindle equipped with sound-proofing elements according to the invention, certain parts of the spindle being shown in section.

FIG. 2 shows a two-roller spindle, with the twist tube ready to operate. This spindle contains a vertical shaft 6 rotating in a bearing 7, mounted on a sliding support member 18. On either side of bearing 7, there is mounted on the top portion of vertical shaft 6 a cylindrical drive pulley 8, and at the bottom of the shaft a roller 9 in the form of a spool with cylindrical faces 10. A shaft 11, parallel to shaft 6, rotating in a bearing 12, is likewise mounted on the support member 18 and carries on the part below the bearing, a roller 13 identical to roller 9, and positioned in facing relation to roller 9. The faces 14 of roller 13, and faces 10 of roller 9 are situate, respectively, in pairs, in two parallel, horizontal planes, and are not quite touching. In the open interval between the pair of rollers, the twist tube 1 is placed, a magnet 15 keeping it in contact with the surfaces 10 and 14 of the rollers. When pulley 8 is driven in rotation by a tangent drive belt, not shown, it drives, in turn, the twist tube by means of its roller 9, and the latter rotates roller 13 on which it rests.

Figure 4:
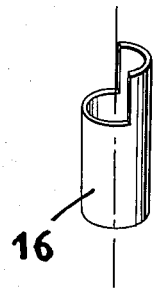
FIGS. 3 and 4 show in schematic perspective, respectively, the various elements forming the sound-proofing device.
Figure 3:
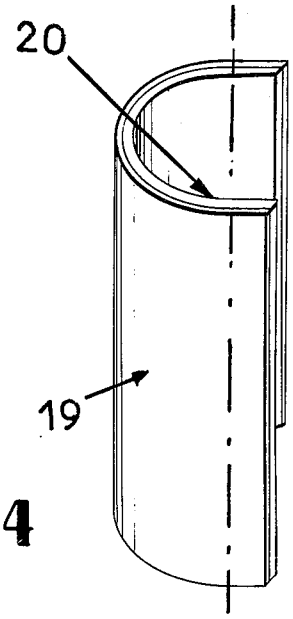

According to the invention, in order to reduce the sonic emissions while allowing free access to the diverse elements of the spindle, a cylindrical shield 16, represented in FIG. 4, made of non-magnetic metal, coaxially envelopes the head 3 of the spindle in its part equipped with the torsion locking member. This cylindrical shield 16 is supportably attached to the frame or support member, for example, by means of a connecting element 17. In addition, a screen 19 (FIG. 3), of semi-cylindrical shape, likewise attached to support member 18, partly surrounds the set of rotating parts of the spindle on the front of the latter.

In one method of embodiment, the shield 16 is embodied as an aluminum tube 1 millimeter in thickness, screen 19 being formed by an aluminum plate 2 millimeters thick, and covered on its inner face with a lining 20 of cellular rubber 5 millimeters thick. The combination of the effects of this two-fold protection is effective because, in the above example, the total sonic intensity of the spindle, whose twist tube is revolving at 600,000 rpm, was brought down from 100 decibels to 87 decibels, with a sound level close to 70 decibels only, instead of 97 decibels for the noises emitted at frequencies of 20,000 Hertz. The measurements were made in classic fashion with the aid of the following equipment:

Bruel and Kjaer group of instruments comprising:

1 a frequency analyser, Type 2107

2 a recorder, Type 2305

3 a ½-inch microphone, Type 4135

4 a standard tone source calibrated at 93.6 decibels at 1,000 Hertz

5 a tachometer, HCW Type DDM 2.

The microphone is placed vertically, level with the spindles, and 40 cm away from the latter.

That which is claimed is:

1. A false twist spindle assembly comprising a twist tube having twist locking means for engaging the yarn to be twisted, at least one rotatable drive roller, magnetic means for holding said tube in contact with the surface of said roller for rotation thereby, and sound reducing means comprising an insulating plate partly surrounding said spindle assembly and an insulating cylinder positioned in closely spaced, coaxial surrounding relation about the portion of the twist tube containing said twist locking means.

2. A false-twist spindle as defined in claim 1, wherein said plate and insulating cylinder are composed of non-magnetic material.

3. A false-twist spindle as defined in claim 2, wherein said plate and insulating cylinder are of aluminum.

4. A false-twist spindle as defined in claim 3, wherein at least one of the insulating members is covered on the inside with a layer of soft material to absorb noises.

* * * * *